US005688374A

United States Patent [19]

Begemann et al.

[11] Patent Number: 5,688,374

[45] Date of Patent: Nov. 18, 1997

[54] HEADBOX AND MANIFOLD SYSTEM FOR PRODUCING A MULTI-PLY PAPER WEB

[75] Inventors: Ulrich Begemann; Hans-Peter Sollinger, both of Heidenheim, Germany

[73] Assignee: Voith Sulzer Papiermaschinen GmbH, Germany

[21] Appl. No.: 540,207

[22] Filed: Oct. 6, 1995

[30] Foreign Application Priority Data

Oct. 7, 1994 [DE] Germany ..... 44 35 860.1

[51] Int. Cl.[6] ..... D21F 1/02; D21F 1/06

[52] U.S. Cl. ..... 162/343; 162/336; 162/344

[58] Field of Search ..... 162/336, 343, 162/338, 212, 344, 347, 272

[56] References Cited

U.S. PATENT DOCUMENTS

| | | | |
|---|---|---|---|
| 3,296,066 | 1/1967 | Green et al. | 162/343 |
| 3,563,852 | 2/1971 | Rojecki | 162/343 |
| 3,640,843 | 2/1972 | Means | 162/300 |
| 3,649,445 | 3/1972 | Bliss, Jr. | 162/343 |
| 3,843,470 | 10/1974 | Betley et al. | 162/336 |
| 3,888,729 | 6/1975 | Parker et al. | 162/343 |
| 4,824,524 | 4/1989 | Hildeebrand | 162/343 |
| 4,890,026 | 12/1989 | Kade | 162/336 |
| 4,895,624 | 1/1990 | Koivisto et al. | 162/343 |
| 4,897,160 | 1/1990 | Wolf et al. | 162/343 |
| 5,183,537 | 2/1993 | Hergert et al. | 162/216 |
| 5,316,383 | 5/1994 | Begemann et al. | 366/160 |
| 5,490,905 | 2/1996 | Huovila et al. | 162/212 |
| 5,545,294 | 8/1996 | Lindén et al. | 162/343 |
| 5,565,064 | 10/1996 | Grimm et al. | 162/216 |

FOREIGN PATENT DOCUMENTS

| | | |
|---|---|---|
| 376 251 | 10/1984 | Germany . |
| 4029545 A1 | 3/1992 | Germany . |
| WO 82/03413 | 10/1982 | WIPO . |
| WO 89/04396 | 5/1989 | WIPO . |

*Primary Examiner*—Donald E. Czaja
*Assistant Examiner*—Jose S. Fortuna
*Attorney, Agent, or Firm*—Baker & Daniels

[57] ABSTRACT

The present invention involves a headbox and manifold system for producing a multi-ply paper which includes a plurality of mixing systems for generation of stock suspension flows of differing concentrations and a distribution manifold for providing a different stock suspension for each of the plies. For at least one of the plies, two conduits or manifolds are used to carry stock suspensions of differing concentrations thereby permitting the adjustment of the concentration of the stock suspension used to form that ply. Each manifold is fixed to the support structure of the paper making machine and runs transverse to the machine direction. Each of the manifolds is in fluid communication with the movable headbox by means of flexible lines of equal length. After discharge from the flexible lines the stock suspensions are routed through turbulence generators before being discharged from the headbox through a slice nozzle to form a multi-ply paper web. The slice nozzle has a width at least as large as the paper web which is formed.

8 Claims, 1 Drawing Sheet

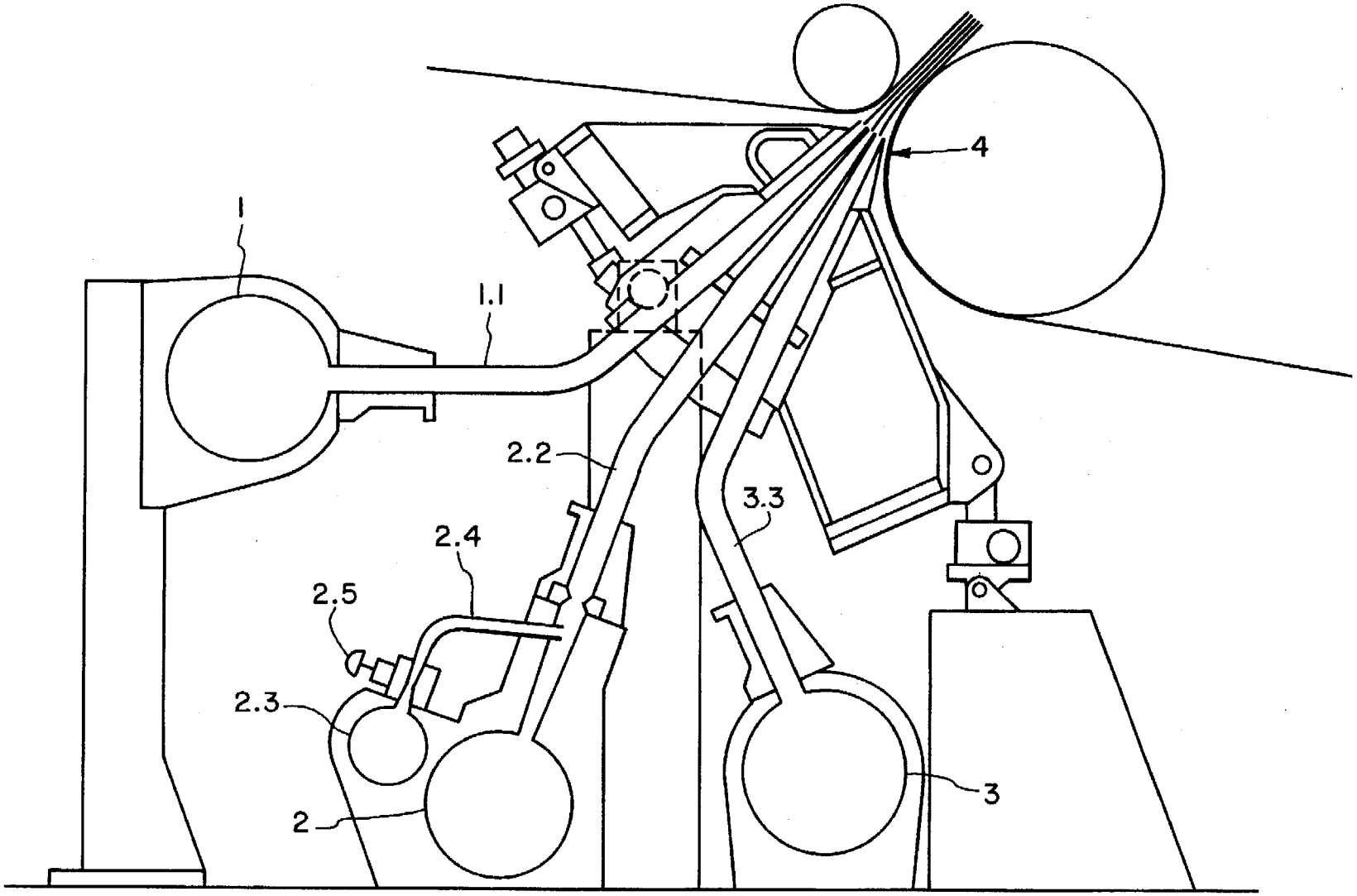
4
1.1
1
2.2
2.4
2.5
2.3
3.3
3
2

HEADBOX AND MANIFOLD SYSTEM FOR PRODUCING A MULTI-PLY PAPER WEB

BACKGROUND OF THE INVENTION

1. Field of the Invention

The invention concerns a combination of a headbox and a manifold system for producing a multi-ply paper web.

2. Description of the Related Art

A multi-ply headbox is known, e.g., from German Patent DE 40 29 545 A1, the disclosure of which is explicitly incorporated by reference. With mutually independent loading of the individual nozzle spaces with stock suspension, a multi-ply headbox enables the production of a multi-ply paper web. Arranged between the individual nozzle spaces of the multi-ply headbox are pivotable lamellae which extend across the machine width and prevent a premature mixing of the various stock suspension flows. Prior headboxes of this type are presently being equipped with manifolds arranged in fixed fashion on the headbox, for which reason very costly connections, so-called compensators, need to be used between the stock suspension feed lines of the fixed part and the manifolds. The purpose of these compensators is to enable relative movements between the headbox and the fixed part at pivoting movements of the headbox for purposes of changing discharge point and the jet angle. A triple ply headbox adapted for influencing the basis weight cross profile by stuff density modification requires four compensators, which on account of their spatial distance relative to each other and to the pivot of the headbox would need to compensate for relative movements considerably greater than would be the case with a conventional single ply headbox employing only one compensator and having a pivot in the vicinity of the compensator axis. These compensators feature a very expensive design in order to ensure that varying operating conditions, such as pressure, temperature, throughputs and headbox positioning, will not cause cross-sectional changes. Brief cross-sectional changes produce pulsations, while permanent changes of cross section will result in a negative effect on the spatial formation of the flow. A further important requirement for compensators used in the paper industry is a design which precludes the formation of deposits and the lodging of fibers.

SUMMARY OF THE INVENTION

The present invention provides an inexpensive multi-ply headbox and manifold system which utilizes flexible lines to connect the headbox and manifold in a paper making machine and does not require the use of compensators.

The invention comprises, in one form thereof, a headbox and manifold system for producing multi-ply paper which includes a plurality of mixing systems for generation of stock suspension flows of different concentration and a distribution conduit or manifold for providing a different stock suspension for each of the plies. For at least one of the plies, two conduits are used to carry stock suspensions of differing concentrations thereby permitting the adjustment of the concentration of the stock suspension used to form that ply. Each manifold is fixed to the support structure of the paper making machine and runs transverse to the machine direction. Each of the manifolds is in fluid communication with the movable headbox by means of flexible lines of equal length. After discharge from the flexible lines the stock suspensions are routed through turbulence generators before being discharged from the headbox through a slice nozzle to form a multi-ply paper web. The slice nozzle has a width at least as large as the paper web which is formed.

An advantage of the present invention is that it does not require expensive compensators thereby reducing the cost of the paper machine and reducing the amount of fiber tuft formation.

Another advantage is the lightweight construction of the present invention. The lighter weight produces a resonant frequency ranging above the usual frequency spectrum which produces stimulation of multi-ply headboxes. The lighter weight also reduces manufacturing costs, owing to reduced use of material.

Yet another advantage is a mechanical decoupling between the headbox and manifold components. This mechanical decoupling greatly reduces the transmission of mechanical vibrations from the pipe system to the headbox and decreases the amount of force required to move the headbox.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 1 is a view of the present invention showing a schematic side elevation of a headbox and manifold system for producing a three-ply fiber web.

Although the drawing represents an embodiment of the present invention, the drawing is not necessarily to scale and certain features may be exaggerated in order to better illustrate and explain the present invention. The exemplification set out herein illustrates an embodiment of the invention, in one form, and such exemplification is not to be construed as limiting the scope of the invention in any manner.

DESCRIPTION OF THE PRESENT INVENTION

A multi-ply head box for producing a three-ply fiber web is illustrated in FIG. 1, and there are three manifolds provided. Each of the manifolds include a main pipe or conduit 1, 2 and 3 arranged transverse to the machine direction and a number of manifold pipes 1.1, 2.2 and 3.3 branching off from each of the main pipes 1, 2 and 3. For each manifold, there are a plurality of manifold pipes 1.1, 2.2. and 3.3 each situated in one respective plane. They extend essentially across the entire width of the paper machine and consist of flexible material. The suspension flows out of the manifold pipes 1.1., 2.2 and 3.3 empty in a slice nozzle 4 of the headbox. The slice nozzle 4 is shown only very schematically in FIG. 1. The mouth of the slice nozzle 4 is preceded by a microturbulence insert, which is formed generally of a bundle of small-diameter tubes of parallel arrangement in the direction of flow. The microturbulence insert is not illustrated in FIG. 1.

The manifold pipes or flexible lines 1.1, 2.2 and 3.3 may have a constant and identical cross-section. The manifold pipes of one manifold may also be configured such that the sum of cross-sectional areas of the flexible lines associated with a main pipe are greater than 0.4 times the cross-sectional area of that main pipe or distribution conduit. A manifold pipe 1.1, 2.2 or 3.3 may also have a cross-section which is approximately rectangular near its respective main pipe or distribution conduit 1, 2 or 3.

Visible on the manifold for producing the middle ply is a second supply pipe 2.3, which is also arranged transverse to the machine direction, but which has a diameter smaller than that of the main pipe 2. Connecting the second supply pipe 2.3 and manifold pipes 2.2 are a number of manifold pipes 2.4. This second supply pipe 2.3, as well as the manifold pipes 2.4, supplies a diluting water (or a stock suspension flow of low concentration). A valve 2.5, which is assigned to each of the individual manifold pipes 2.4 is also illustrated in FIG. 1. With the second supply pipe 2.3, manifold pipes 2.4 and valves 2.5 it is possible to produce, by appropriate admixture, in the manifold pipes 2.2 sectional flows which with respect to fiber orientation and concentration have the desired values.

The use of a second supply pipe for purposes of controlling fiber orientation and concentration can also be realized, of course, with the manifolds of the two outer plies. However, this is not mandatory.

It is particularly advantageous to make sure that the manifold pipes 1.1, 2.2 and 3.3 can be decoupled from the web forming components of the headbox, the description of which follows hereafter. The web forming components include the previously mentioned turbulence insert as well as the slice nozzle 4. It is advantageous to make the web forming components pivotable in order to vary the angle at which the jet is discharged from the slice nozzle.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A headbox and manifold system in a paper machine having a rapport structure and a plurality of mixing systems for generating stock suspension flows of differing concentrations for producing a multi-ply paper comprising:

a manifold for each ply of the multi-ply paper, each of said manifolds having distribution conduit arranged transverse to the paper machine direction for conveying one of said stock suspension flows, said manifolds affixed to the paper machine support structure;

each of said manifolds having a plurality of equal length flexible lines providing fluid communication between each respective distribution conduit and a pivotable head box wherein said flexible lines permit relative movement between said headbox and said respectively manifolds without the use of compensators;

said headbox supported by the paper machine support structure;

a slice nozzle extending across an entire width of the multi-ply paper; said slice nozzle attached to and in fluid communication with said headbox, said plurality of stock suspension flows discharged by said slice nozzle;

a turbulence generator for each of said plies located between said manifolds and said slice nozzle; and at least one second conduit for introducing a fluid into one of said stock suspension flows before said respective turbulence generator whereby said concentration of said stock suspension flow can be adjusted.

2. The multi-ply headbox and manifold system of claim 1 wherein said flexible lines have a constant and identical cross-section.

3. The multi-ply headbox and manifold system of claim 1 wherein at least one of said distribution conduits has a first cross-sectional area and said flexible lines of said at least one distribution conduit each have a second cross-sectional area and a sum of said second cross-sectional areas is greater than 0.4 times said first cross-sectional area.

4. The multi-ply headbox and manifold system of claim 2 wherein at least one of said distribution conduits has a first cross-sectional area and said flexible lines of said at least one distribution conduit each have a second cross-sectional area and a sum of said second cross-sectional areas is greater than 0.4 times the first cross-sectional area.

5. The multi-ply headbox and manifold system of claim 1 wherein at least one of said flexible lines has a cross-section which is substantially rectangular near said distribution conduit.

6. The multi-ply headbox and manifold system of claim 2 wherein at least one of said flexible lines has a cross-section which is substantially rectangular near said distribution conduit.

7. The multi-ply headbox and manifold system of claim 3 wherein at least one of said flexible lines has a cross-section which is substantially rectangular near said distribution conduit.

8. The multi-ply headbox and manifold system of claim 4 wherein at least one of said flexible lines has a cross-section which is substantially rectangular near said distribution conduit.

* * * * *

UNITED STATES PATENT AND TRADEMARK OFFICE

CERTIFICATE OF CORRECTION

PATENT NO. : 5,688,374

DATED : November 18, 1997

INVENTOR(S) : Ulrich Begemann and Hans-Peter Sollinger

It is certified that error appears in the above-identified patent and that said Letters Patent is hereby corrected as shown below:

Claim 1, Col. 3, Line 37, delete "rapport" and insert --support--.
Claim 1, Col. 3, Line 41, after "having" insert --a--.

Signed and Sealed this

Third Day of February, 1998

*Attest:*

Bruce Lehman

BRUCE LEHMAN

*Attesting Officer*

*Commissioner of Patents and Trademarks*